United States Patent [19]

van Tol

[11] 4,443,737

[45] Apr. 17, 1984

[54] DEVICE FOR DISPLAYING PICTURES BY MEANS OF A CATHODE-RAY TUBE

[75] Inventor: Maurits W. van Tol, Almelo, Netherlands

[73] Assignee: U.S. Philips Corporation, New York, N.Y.

[21] Appl. No.: 330,622

[22] Filed: Dec. 14, 1981

[30] Foreign Application Priority Data

Jan. 14, 1981 [NL] Netherlands ..... 8100142

[51] Int. Cl.[3] ..... H01J 29/76

[52] U.S. Cl. ..... 313/431; 313/440

[58] Field of Search ..... 313/440, 366, 431, 392, 313/397, 398

[56] References Cited

U.S. PATENT DOCUMENTS 3,424,942 1/1969 Barbin ..... 313/440 X

*Primary Examiner*—Palmer C. Demeo

*Attorney, Agent, or Firm*—Robert J. Kraus

[57] ABSTRACT

By causing the deflection of an electron beam (13) in a cathode-ray tube having a main system of deflection coils (4) and a system of post-deflection coils (5) to take place on the side of the display screen of the main system of deflection coils, which system of post-deflection coils causes a post-deflection of the electron beam opposite to the deflection by the main system of deflection coils which after deflection is synchronous with and weaker than the deflection by the main system of deflection coils, it is possible to choose the place of the (virtual) deflection point of the combination of main and post-deflection coil system more or less at will. By choosing L, the distance from said virtual deflection point to the display screen, to be substantially equal to 21, where l is the effective length of the overall magnetic deflection field, a substantially anastigmatic deflection sytstem is obtained.

4 Claims, 6 Drawing Figures

DEVICE FOR DISPLAYING PICTURES BY MEANS OF A CATHODE-RAY TUBE

BACKGROUND OF THE INVENTION

The invention relates to a device for displaying pictures by means of a cathode-ray tube which comprises in an evacuated envelope a display screen and an electron gun for generating an electron beam, which cathode-ray tube has a main system of deflection coils provided around the tube for deflecting the electron beam over the display screen in two mutually transverse directions.

Such a device is known from Netherlands Patent Application No. 7707008 laid open to public inspection on Dec. 12, 1978, in which a device is shown having a cathode-ray tube for projection television purposes.

Deflection coils used in cathode-ray tubes often cause electron optical aberrations in the deflected electron beam. The most important aberrations are astigmatism, curvature of the field and coma. These are the so-called third-order aberrations. In addition to these third-order aberrations, picture defects of the fifth and seventh order also occur. However, these are of importance only at large values of the distance s of the electron beam from the axis of the system of deflection coils in the deflection field and of the tangent of the deflection angle $\phi$. These aberrations can be corrected by using dynamic corrections synchronously with the deflection. For example, astigmatism is corrected by means of one or two dynamic quadrupoles, curvature of the field is corrected by means of dynamic focusing and coma errors are corrected by means of dynamic sexapole, octapole and decapole fields.

From the article "A practical approach to the third-order theory of magnetic deflection and its application to the deflection of convergent electron beams", Digest of Technical Papers of the International Symposium 1980 of the Society for Information Display, San Diego, Calif., which may be considered to be incorporated herein by reference, it follows that, when the horizontal and vertical deflection fields are substantially identical two-pole fields having an effective length $$l_3 = L/2 \tag{1}$$

wherein L is the distance between the deflection point of the system of deflection coils to the display screen, no third-order astigmatism occurs. Moreover it is stated that the effective length must be taken to be slightly larger than shown in (1) in connection with fifth-order aberrations. The effective length $l_3$ is determined by the length and the shape of the magnetic field and is defined in P. E. Kaus, RCA Rev. 17, 168, 1956

$$l_3 = \left[ \int_{Z_O}^{Z_S} H_d \, dZ \right]^2 / \int_{Z_O}^{Z_S} H_d^2 \, dZ \tag{2}$$

where $H_d$ is the generated magnetic field as a function of the place Z on the axis of the system of deflection coils. In short cathode-ray tubes, however, it is not possible to satisfy the requirement as indicated in (1) because the system of deflection coils must be provided comparatively close to the display screen. It is also attractive when the place of the deflection point can be chosen to be more or less independent of the coil dimensions and coil shape.

SUMMARY OF THE INVENTION

It is therefore an object of the invention to provide a device having a construction of deflection coils in which it is possible to choose the place of the virtual electron optical deflection point of the combination of the main system of deflection coils and an oppositely acting system of deflection coils more or less arbitrarily.

Another object of the invention is to be able to satisfy the requirement as indicated in (1) by this construction also in the case of comparatively short tubes so that an anastigmatic deflection is obtained.

For that purpose, a device of the kind described in the opening paragraph which is characterized in that a second system of post-deflection coils is additionally provided around the display tube located between the display screen and the main system of deflection coils, which second system produces a post-deflection of the electron beam in a direction opposite to that of the main system of deflection coils, which post-deflection is synchronous with but weaker than the deflection produced by the main system of deflection coils.

Although U.S. Pat. No. 2,728,027 describes a device having two synchronously and oppositely acting systems of deflection coils, the system of deflection coils present on the electron gun side in this device causes a pre-deflection of the electron beam which is much weaker than the deflection by the main system of deflection coils and which pre-deflection serves to make a larger deflection angle possible.

The point of intersection of the rearwards projected path of the electron beam adjacent the second system, when subjected to maximum deflection, with the path of the electron beam, when undeflected, may be considered as the virtual deflection point of the combination of the main system of deflection coils and the second system of post-deflection coils. By choosing the strength of the post-deflection it is possible to choose the place of said virtual deflection point more or less independently of the shape and dimensions of the system of deflection coils.

A first preferred embodiment of the invention is characterized in that the point of intersection of the rearward projected path of the maximum deflected electron beam with the path of the non-deflected electron beam is situated at a distance L from the display screen, in which it holds that L is substantially equal to 2l wherein l is the effective length (according to the above given definition) of the overall magnetic deflection field of the main- and second system of deflection coils measured along the path of the undeflected electron beam. In that case the requirement as described in (1) is more or less satisfied by using the invention and the third- and fifth-order astigmatisms are considerably reduced, as will be demonstrated hereinafter with reference to an embodiment.

A second preferred embodiment of the invention is characterized in that the main system of deflection coils and the associated second system of post-deflection coils for deflection in the same transverse direction may be connected in series.

The invention is particularly suitable for use in projection television display tubes, because such tubes are comparatively short.

BRIEF DESCRIPTION OF THE DRAWING

Features of the invention will now be described in greater detail, by way of example, with reference to the accompanying drawing in which.

DESCRIPTION OF THE PREFERRED EMBODIMENT

Figure 1:
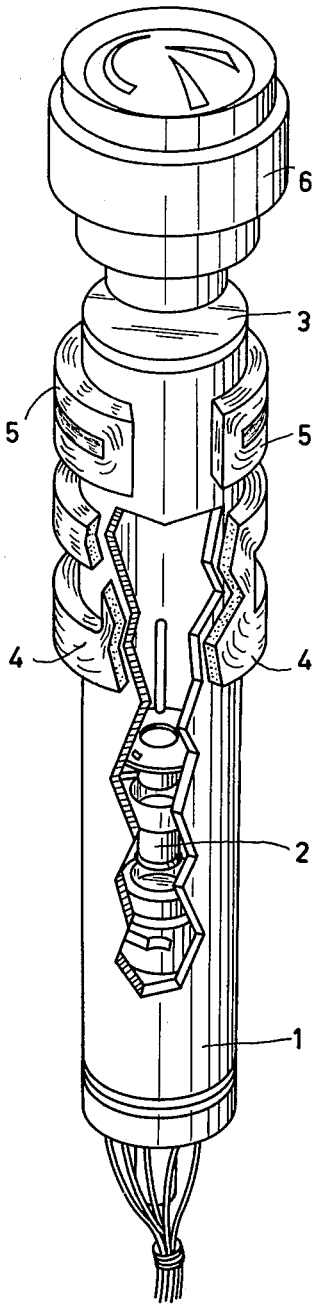
FIG. 1 is a perspective view, partly in section of a device according to the invention.

The device according to the invention shown in FIG. 1 comprises a cathode ray tube with an electron gun 2 in an evacuated envelope which is closed by a window which also forms the display screen 3 and which consists of a single crystal activated on one side. Such a cathode-ray tube having a single crystal display screen for projection purposes has already been described in the previously mentioned Netherlands Patent Application No. 7707008 laid open to public inspection which may be considered to be incorporated herein by reference. The tube is surrounded by a main system comprising a pair of deflection coils 4 and a second system comprising a pair of post-deflection coils 5 which effect the horizontal line deflection of the electron beam generated in the electron gun 2. The two systems of deflection coils may be connected in series. Corresponding systems of main- and post-deflection coils which are rotated 90° relative to the first systems and which effect the vertical field deflection, are not shown to avoid complexity of the drawing. Beyond the display screen 3 a system of lenses 6 is provided for projecting the very bright picture of the display screen 3 onto a projection screen. The shape and dimensions of the main deflection coils and the post-deflection coils will be described after the description of FIG. 4.

Figure 2:
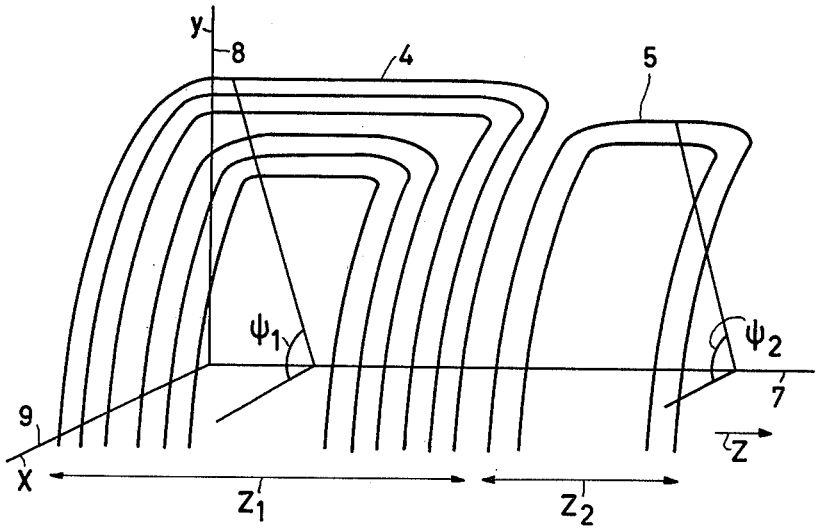
FIG. 2 shows diagrammatically a quadrant of a system of main and post-deflection coils used in the device of FIG. 1.

FIG. 2 shows diagrammatically a quadrant of a main deflection coil 4 and a post-deflection coil 5, which coils serve for the vertical deflection. The axis 7 of the deflection coils coincides substantially with the tube longitudinal axis. The Y-axis 8 and the X-axis 9 extend in the vertical and horizontal directions, respectively, and are perpendicular to the Z-axis 7. With a given overall length $Z_1+Z_2$ and a given number of turns three degrees of freedom remain, as appears from this figure, which are indicated as the angles $\phi_1$ and $\phi_2$ which determine the sexapole/dipole relation of the main deflection coil 4 and post-deflection coil 5 and the relation $Z_2/Z_1$ which is a measure of the relative strength of the post-deflection field.

Figure 3:
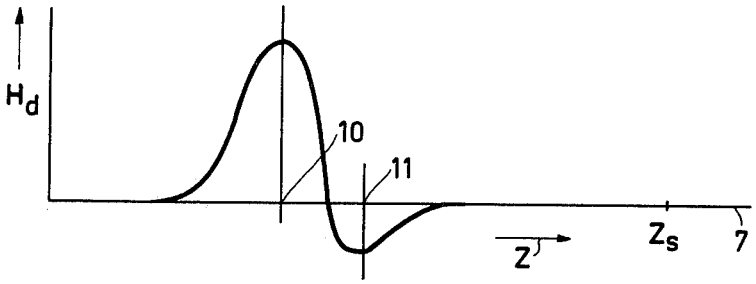
FIG. 3 shows the strength of the magnetic field generated by such systems of main deflection coil and post-deflection coil as a function of the place on the longitudinal axis.
Figure 4:
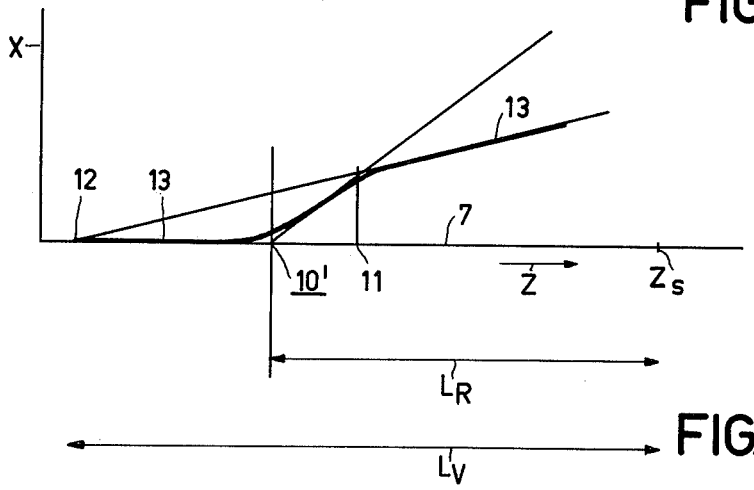
FIG. 4 shows the influence on the electron beam of the magnetic field of FIG. 3, and FIGS. 5 and 6 further explain the determination of the aberration coefficients.

FIG. 3 shows the magnetic field $H_d$ generated by such a main deflection coil and post-deflection coil as a function of the place Z on the axis 7. The point Zs indicates the position of the display screen. The points 10 and 11 are the points of a maximum field strength in the main deflection coil and the post-deflection coil, respectively. The magnetic field of the post-deflection coil in absolute value is weaker and moreover oppositely directed to the magnetic field of the main deflection coil. The magnetic field variation in a device in accordance with the invention as shown in FIG. 3 influences the electron beam 13 generated by the electron gun as shown in FIG. 4. This electron beam enters the magnetic field on the left-hand side of the Figure. As a result of the magnetic field of the main deflection coil 4 the electron beam 13 experiences a first deflected. The deflection electron beam 13 seems to originate from the point 10' which, in practice, proves to coincide substantially with the point 10. As a result of the magnetic field of the post-deflection coil the electron beam then experiences a second deflection at the position of point 11 on the Z-axis. Because the magnetic field of the post-deflection coil is weaker than and has a polarity opposite to that of the main deflection coil, this results in a partial reflection of the electron beam 13. It will be obvious that the deflection sensitivity of the system is slightly decreased by this. The electron beam 13 which has been deflected by the main system of deflection coils and the system of post-deflection coils, viewed from the display screen, seems to originate (when the beam is projected to the rear) from a virtual deflection point 12. The invention is based on the recognition of the fact that, although said deflection point 12 is virtual, it is nevertheless the distance $L_V$ (L-virtual) from the deflection point to the display screen ($Z_s$) and not the distance $L_R$ (L-real) which together with the strength of the sexapole field component determines how large the aberrations of the third-order of the system are. The invention will now be described in greater detail with reference to an embodiment. In a device as described in FIGS. 1 and 2 deflection coils were used with the parameters indicated in the following table.

| Horizontal deflection $d_g$ = 32 mm | | Vertical deflection $d_g$ = 34 mm | |
|---|---|---|---|
| Main deflection | Post-deflection | Main deflection | Post-deflection |
| $Z_1$ = 28.6 mm | $Z_2$ = 14.6 mm | $Z_1$ = 28.6 mm | $Z_2$ = 14.6 mm |
| $\chi_1 = 78°$ | $\chi_2 = 71°$ | $\phi_1 = 77°$ | $\phi_2 = 69°$ |

In the table $d_g$ is the average diameter of the main and post-deflection coils and $\chi_1$ and $\chi_2$ are the equivalents of $\phi_1$ and $\phi_2$ for the horizontal deflection magnetic field. These dimensions for the deflection coils, when the display screen is at 55 mm from the beginning of the deflection coil system, seen in the direction of propagation of the electron beam, give an anastigmatic (circular) spot over substantially the whole display screen. So the invention enables the design of anastigmatic deflection coils with very small distances between the deflection point 12 and the display screen. This is also theoretically demonstrable. For that purpose it is necessary first to define a number of concepts.

Figure 5:
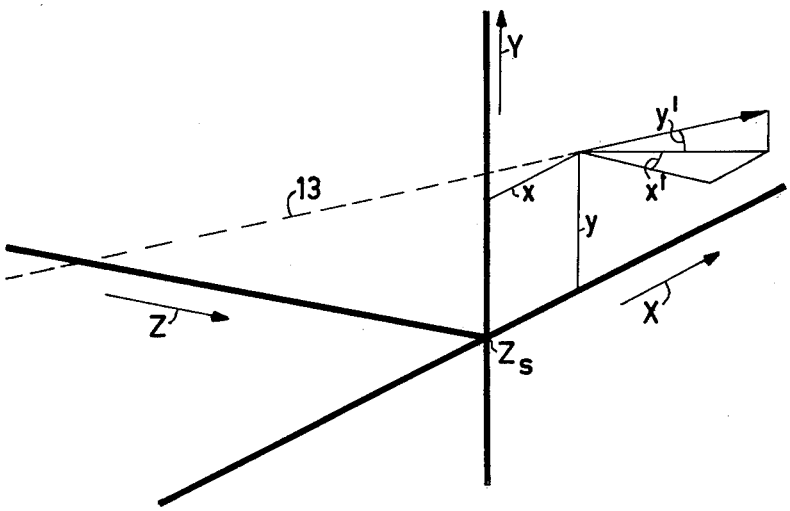
Figure 6:
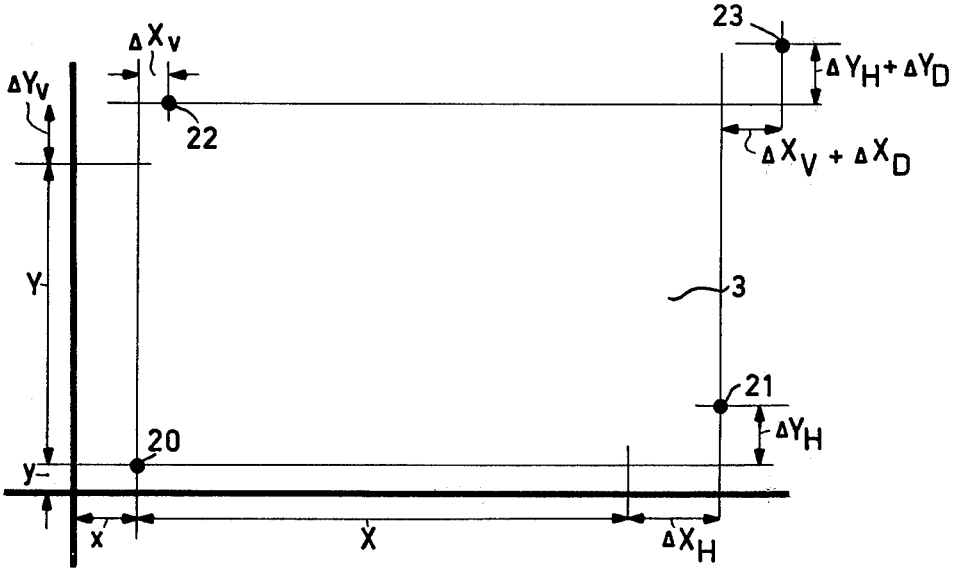

FIG. 5 shows a system of axes of which the Z-axis coincides with the axis of symmetry of the deflection system to be described and the XY-plane is situated in the plane of the display screen. The horizontal deflection takes place in the X-direction and the vertical deflection takes place in the Y-direction. An arbitrary electron path can now be defined by its point of intersection (x, y) with the XY-plane and the angles (x', y') which the path makes with the $Z^-$-axis at the area of the screen. A current $i_x$ through the horizontal main and post-deflection coils will deflect the path of the electron beam so that the point of intersection 20 of the central path with the display screen moves to point 21. The horizontal deflection to point 21 may be considered to be built up from a part X which is proportional to $i_x$, the ideal or Gausian deflection, and two aberration contributions $\Delta X_H$ and $\Delta Y_H$. The vertical deflection is built up analogously from a part Y which is proportional to $i_y$ and two aberration contributions $\Delta X_V$ and $\Delta Y_V$. In the case of an electron beam with beginning coordinates (x,y), which is deflected in a horizontal direction from point 20 to point point 21 on the display screen 3, the new point of intersection 21 with the display screen becomes $(x+X+\Delta X_H,\ Y+\Delta Y_H)$. When the electron beam is deflected in the vertical direction the new point of intersection 22 has the coordinates: $(x+\Delta X_V,\ y+Y+\Delta Y_V)$.

Deflection in a diagonal direction from point 20 to point 23 will generally still give rise to a number of extra aberrations $\Delta X_D$ and $\Delta Y_D$ so that it holds for the coordinates: $(x+X+\Delta X_H+\Delta X_V+\Delta X_D,\ y+Y+\Delta Y_H+\Delta Y_V+\Delta Y_D)$.

The indices H, V and D denote horizontal, vertical and diagonal.

In the case of horizontal deflection a number of error coefficients occur.

$$\Delta X_H = A_{301}X^3 + (A_{304}X^2x' + A_{309}X^2x) + \text{comaerrors} +$$

$$\Delta Y_H = (A_{305}X^2y' + A_{310}X^2y) + \text{comaerrors} +$$

Vertical deflection gives in an analogous manner $$\Delta X_V = (B_{305}Y^2x' + B_{310}Y^2x) + \text{comaerrors} +$$

$$\Delta Y_V = B_{301}Y^3 + (B_{304}Y^2y' + B_{309}Y^2y) + \text{comaerrors} +$$

while in the case of simultaneous horizontal and vertical deflection the following terms appear:

$$\Delta X_D = (A_{302}+B_{303})XY^2 + (A_{306}+B_{306})XYy' + (B_{311}+A_{312})XYy +$$

$$\Delta Y_D = (B_{302}+A_{303})X^2Y + (A_{306}+B_{306})YXx' + (A_{311}+B_{312})XYx +$$

The terms with $A_{301}$ $A_{302}$ and $A_{303}$ together with their equivalents $B_{301}$ $B_{302}$ and $B_{303}$ denote the occurring nonlinearity and rester distortion. The coma errors defined by the coefficients $A_{307}$ $A_{308}$ and $A_{313}$ are not written. The third-order astigmatism is fully determined by the system of coefficients $A_{304}$ $A_{305}$ $A_{306}$ $A_{309}$ to $A_{312}$ and their B-equivalents for the vertical deflection coil.

The relative importance of the coefficients $A_{304}$ $A_{305}$ and $A_{306}$ on the one hand and $A_{309}$ $A_{310}$ $A_{311}$ and $A_{312}$ on the other hand is determined by the shape of the electron beam. In most of the cases and certainly in most electron ray tubes for projection television a wide beam is focused on a small spot: in other words the angles x' and y' are large as compared with the ratio between the spot dimensions (x,y) and the distance L between the virtual deflection point and screen. Therefore the coefficients $A_{309}$ to $A_{312}$ and $B_{309}$ to $B_{312}$ are neglected hereinafter.

The requirements to be imposed on an anastigmatic deflection coil are that with any deflection, horizontal, vertical and diagonal, the spot should remain circular so that the curvature of the field can be corrected for by means of dynamic focusing. In order to keep the spot circular in horizontal deflection of a rotationally symmetrical conical beam it must be satisfied that:

$$A_{304} = A_{305}.$$

Also with vertical deflection the spot should remain circular and hence it should be satisfied that $$B_{304} = B_{305}.$$

Finally, the spot should also remain circular in the case of diagonal deflection so that as a third requirement, the coefficients $A_{306}$ of the horizontal deflection must be opposite to its equivalent $B_{306}$ of the vertical deflection coil.

The embodiment described employs rectangular coils wound on a cylinder surface (see FIG. 1). When the ratio $Z_2/Z_1$ is chosen to be equal for the horizontal and vertical deflection coils, some five dimensions to be chosen remain, namely the opening angle $\phi_1$ and $\phi_2$ of the vertical system of deflection and their equivalents $\chi_1$ and $\chi_2$ for the horizontal deflection system and the ratio $Z_2/Z_1$. Because only three conditions need be satisfied for anastigmatism, namely $$A_{304} - A_{305} = B_{304} - B_{305} = A_{306} + B_{306}$$

it is possible to make two out of the six coma coefficients to be zero.

The dimensions of the embodiment described give the following aberration coefficients:

| | |
|---|---|
| $A_{301}$ = 30.8 ($m^{-2}$) | $B_{301}$ = 33.0 ($m^{-2}$) |
| $A_{302}$ = 35.8 ($m^{-2}$) | $B_{302}$ = 34.8 ($m^{-2}$) |
| $A_{303}$ = 1.5 ($m^{-2}$) | $B_{303}$ = −0.6 ($m^{-2}$) |
| $A_{304}$ = 14.4 ($m^{-1}$) | $B_{304}$ = 13.3 ($m^{-1}$) |
| $A_{305}$ = 14.4 ($m^{-1}$) | $B_{305}$ = 13.3 ($m^{-1}$) |
| $A_{306}$ = −2.5 ($m^{-1}$) | $B_{306}$ = 2.5 ($m^{-1}$) |
| $A_{307}$ = 0.9 (—) | $B_{307}$ = 0.9 (—) |
| $A_{308}$ = 0.0 (—) | $B_{308}$ = 0.0 (—) |

So in this example it has been chosen to make $A_{308}$ and $B_{308}$ zero. It is thus possible by means of the invention to design anastigmatic deflection coils with comparatively very small distances from the deflection points to the display screen.

What is claimed is:

1. A device for displaying pictures comprising a cathode-ray tube having an evacuated envelope with a display screen and an electron gun for generating an electron beam, which cathode-ray tube has a main system of deflection coils provided around the tube for deflecting the electron beam over the display screen in two mutually transverse directions, characterized in that a second system of post-deflection coils is additionally provided around the display tube located between the display screen and the main system of deflection coils which second system comprises a post-deflection of the electron beam in a direction opposite to that of the main system of deflection coils, which post-deflection is synchronous with but weaker than the deflection produced by the main system of deflection coils.

2. A device as claimed in claim 1, characterized in that the point of intersection of the rearward projected path of the electron beam adjacent the second system, when subjected to maximum deflection, with the path of the electron beam, when un-deflected, is situated at a distance L from the display screen, where L is substantially equal to 2l and l is the effective length as herein defined of the overall magnetic deflection field of the main and second systems of deflection coils measured along the path of the un-deflected electron beam.

3. A device as claimed in claim 1 or 2, characterized in that the main system of deflection coils and the second system of post-deflection coils are connected in series.

4. A device as claimed in claim 1 or 2, characterized in that the cathode-ray tube is a projection television display tube.

* * * * *